US005399203A

United States Patent [19]

Ishikawa et al.

[11] Patent Number: 5,399,203

[45] Date of Patent: Mar. 21, 1995

[54] METHOD FOR CLEANING OIL-DEPOSITED MATERIAL

[75] Inventors: Makoto Ishikawa, Yokohama; Tetsuhiro Yamauchi, Kurashiki; Kazunari Takahashi, Kurashiki; Soichi Orita, Kurashiki; Tetsuo Asanuma, Kurashiki; Noboru Ueki, Kurashiki; Masayuki Hattori, Kurashiki; Satoshi Yamazaki, Kurashiki, all of Japan

[73] Assignee: Mitsubishi Kasei Corporation, Tokyo, Japan

[21] Appl. No.: 46,308

[22] Filed: Apr. 15, 1993

[30] Foreign Application Priority Data

| | | | |
|---|---|---|---|
| Apr. 20, 1992 | [JP] | Japan | 4-99387 |
| Aug. 18, 1992 | [JP] | Japan | 4-219144 |
| Sep. 30, 1992 | [JP] | Japan | 4-261312 |
| Oct. 2, 1992 | [JP] | Japan | 4-265187 |

[51] Int. Cl.[6] ..... B08B 3/02; B08B 3/04; B08B 7/00; C23G 5/00

[52] U.S. Cl. ..... 134/010; 134/26; 134/30; 134/40

[58] Field of Search ..... 134/26, 30, 40, 10

[56] References Cited

U.S. PATENT DOCUMENTS

| | | | |
|---|---|---|---|
| 4,376,069 | 3/1983 | Maggi | 134/40 |
| 4,778,532 | 10/1988 | McConnell et al. | 134/10 |
| 5,085,795 | 2/1992 | Narayanan et al. | 134/40 |

FOREIGN PATENT DOCUMENTS

| | | |
|---|---|---|
| 49-128908 | 12/1974 | Japan . |
| 64-81949 | 3/1989 | Japan . |
| 1081949 | 3/1989 | Japan . |
| 1-188311 | 7/1989 | Japan . |
| 4-68094 | 3/1992 | Japan . |
| 4-68095 | 3/1992 | Japan . |
| 4068094 | 3/1992 | Japan . |
| 2191501 | 12/1987 | United Kingdom . |

OTHER PUBLICATIONS

SU-1,627,593, Derwent abstract.
SU-1,249,067, Derwent abstract.

*Primary Examiner*—Melvyn J. Andrews
*Assistant Examiner*—Zeinab El-Arini
*Attorney, Agent, or Firm*—Oblon, Spivak, McClelland, Maier & Neustadt

[57] ABSTRACT

Disclosed herein are a method of cleaning an oil-deposited material, which comprises cleaning a material having oils deposited on the surface thereof with a cleaning agent comprising 25 to 90% by weight of at least one of compounds selected from the group consisting of pyrrolidones, γ-butyrolactone and N,N-dimethylacetamide, and 10 to 75% by weight of water, then eliminating at least a portion of the deposited cleaning agent from said material to be cleaned by a physical means, and then applying water-washing with water, steam or water and steam; an apparatus for cleaning an oil-deposited materialhaving oils deposited on the surface thereof; and a cleaning agent therefor.

16 Claims, 2 Drawing Sheets

METHOD FOR CLEANING OIL-DEPOSITED MATERIAL

BACKGROUND OF THE INVENTION

The present invention relates to a method of and an apparatus for cleaning an oil-deposited material, as well as a cleaning agent used therefor, and more in particular, it relates to a method of and an apparatus for cleaning an oil-deposited material for effectively cleaning and removing oils deposited (extraneous oils) to a material to be cleaned such as metal parts, as well as a cleaning agent used therefor.

In a step of cutting fabrication for metal parts such as precision instrument parts and electric parts, cutting oils, etc. are used with an aim of reducing friction between a material to be cutting-worked and a cutting tool, removing a great amount of frictional heat generated upon fabrication, washing out of cutting wastes, improving the working life of cutting tools and smoothing a finished surface.

Accordingly, oils are deposited to a fabricated metal material and the fabricated metal material can not be used as a final product as it stands in a state where the oils are deposited. Accordingly, in a finishing step for such parts, oils are cleaned and removed by using organic solvents.

As known organic solvents used for cleaning and removing the oils, hydrocarbon-type solvents such as kerosene, benzene and xylene, chloro-type solvents such as trichloroethylene and tetrachloroethylene and flon-type solvents such as trichlorofluoroethane, etc. can be used. In particular, flon- or chloro-type solvents having high cleaning ability and incombustibility have been used for cleaning electronic, electric, or machinery metal parts.

However, among the known organic solvents described above, the hydrocarbon solvents, in particular, benzene and xylene are compounds having high toxicity and specified as deleterious materials in view of labor safety law, and accordingly, there has been a problem of risk and trouble for a handling operation. Further, the chloro- or flon-type solvents involve a great problem, for example, in view of safety, toxicity and environmental pollution.

For overcoming the foregoing problems in cleaning agents comprising organic solvents such as benzene and xylene, and flon-type solvent, the following cleaning agents have been proposed.

Japanese Patent Application Laid-Open (KOKAI) No. 49-128908 proposes a cleaning agent composition containing N-methyl-2-pyrrolidone and a surfactant, in which the content of the surfactant is 0.1 to 30% by weight based on the sum of both components.

Japanese Patent Application Laid-Open (KOKAI) No. 1-188311 proposes a mold cleaning agent containing not less than 20% by weight of pyrrolidone and/or derivative thereof, and if necessary, a viscosity improver, a surfactant and a solvent such as monohydric alcohols, polyhydric alcohols (for example, ethylene glycol, diethylene glycol, propylene glycol, glycerine, cellosolves and carbitols), dimethylsulfoxide, diethylsulfoxide, N,N-dimethylformamide or N,N-dimethylacetamide.

Japanese Patent Application Laid-Open (KOKAI) No. 4-68094 proposes a degreasing and cleaning agent comprising, as the essential ingredient:

(1) a nonionic surfactant of 1 to 30% by weight, and
(2) one or more of compounds selected from N-methylpyrrolidone, 2-pyrrolidone, r-butyrolacton. dimethylsulfoxide, sulfolane and propylene carbonate.

However, the proposed cleaning agents still involve problems in view of safety, sanitation for working circumstance and environmental pollution.

As a result of the present inventors' earnest studies, it has been found that by cleaning a material having oils deposited on the surface thereof with a cleaning agent containing at least one of pyrrolidones, γ-butyrolacton and N,N-dimethylacetamide, and water, eliminating at least a portion of the deposited cleaning agent from the material to be cleaned by a physical means, and then water-washing the material with water and/or steams, an oil-deposited material can be cleaned with an excellent degreasing and cleaning effect for oils, with a satisfactory safety and sanitation for working circumstance and with a less burden for waste-water treatment, and can be free from the worry of environmental contamination. The present invention has been attained on the basis of this finding.

SUMMARY OF THE INVENTION

An object of the present invention is to provide a method of cleaning an oil-deposited material, which is excellent in degreasing and cleaning performance for oils, shows satisfactory safety and sanitation for working circumstance, and is free from the problem of environmental contamination; a cleaning apparatus; and cleaning agent used therefor.

To achieve the object, in a first aspect of the present invention, there is provided a method of cleaning an oil-deposited material, which comprises cleaning a material having oils deposited on the surface thereof with a cleaning agent comprising 25 to 90 % by weight of at least one of compounds selected from the group consisting of pyrrolidones, γ-butyrolactone and N,N-dimethylacetamide, and 10 to 75% by weight of water, then eliminating at least a portion of the deposited cleaning agent from the material to be cleaned by a physical means, and then water-washing with water and/or steam.

In a second aspect of the present invention, there is provided an apparatus for cleaning a material having oils deposited on the surface thereof, comprising an oil-cleaning section for cleaning the material having oils deposited on the surface thereof with a cleaning agent comprising 25 to 90 % by weight of at least one of compounds selected from the group consisting of pyrrolidones, γ-butyrolactone and N,N-dimethylacetamide, and 10 to 75% by weight of water; a deposit-eliminating section for eliminating at least a portion of the deposited cleaning agent by a physical means from the material to be cleaned; a water-washing section for removing the cleaning agent remaining on the surface of the material to be cleaned, a gas blowing and drying section for removing water deposited to the material to be cleaned after water-washing; and a transportation device for successively transporting the material to be cleaned from the oil-cleaning section, the deposit-eliminating section, the water-washing section to the gas blowing and drying section.

In a third aspect of the present invention, there is provided a cleaning agent for an oil-deposited material comprising 25 to 90 % by weight of at least one of compounds selected from the group consisting of pyrrolidones, γ-butyrolactone and N,N-dimethylacetamide, and 10 to 75% by weight of water.

DETAILED DESCRIPTION OF THE INVENTION

Figure 1:
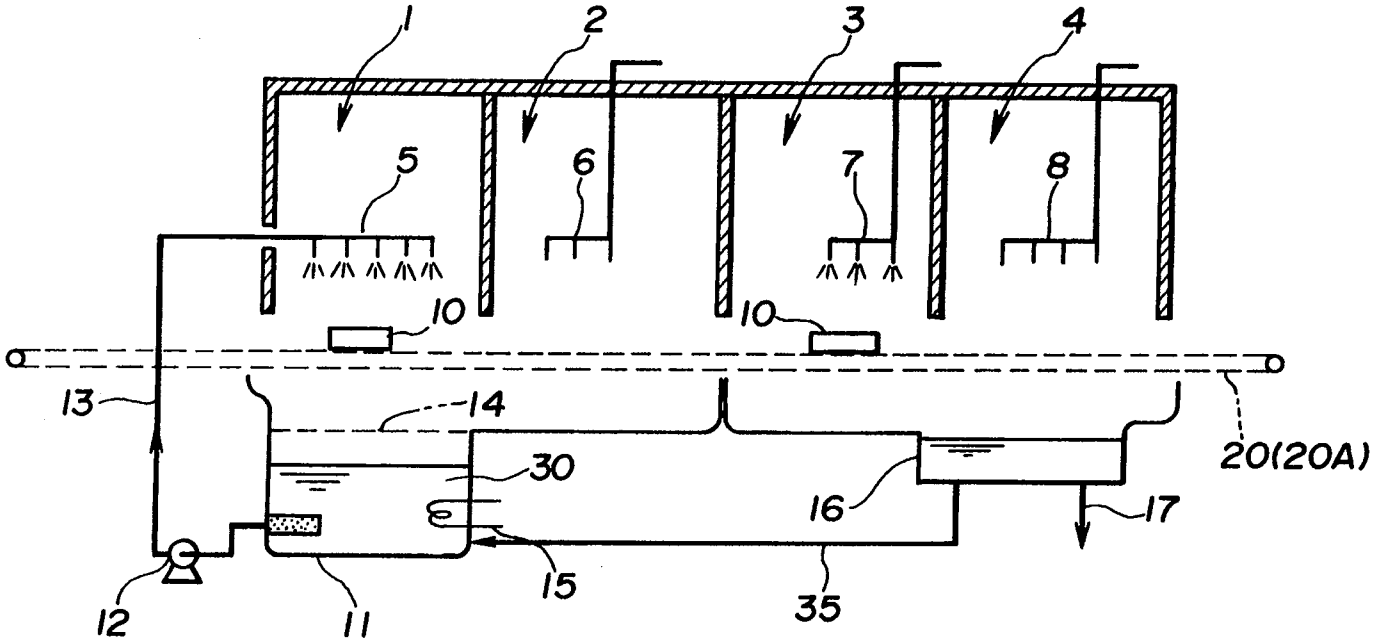
FIG. 1 is an explanatory view illustrating a preferred embodiment of an apparatus for cleaning an oil-deposited material according to the present invention.

In the present invention, a material to be cleaned having oils deposited thereon as an object of the cleaning treatment mainly include metal parts, for example, precision components such as electronic parts, electric parts, precision instrument parts, resin fabrication parts and optical parts, machine parts and automobile parts, as well as jigs and tools used for assembling and fabrication steps therefor. Specifically, there can be mentioned electronic parts such as printed circuit substrates, IC lead frames, capacitors, liquid crystal display devices and semiconductor materials; electric parts such as motor cores, electric motor parts such as magnets, brushes and housings; precision instruments parts such as bearings, sewing machine parts and fabrication parts; optical parts such as lenses; machine parts such as bearings, gears and various kinds of other machine parts; and automobile parts such as engine parts, mission gears and carburetors. In addition, as jigs and tools used for assembling and fabrication steps therefor, there can be mentioned jigs and tools used in various kinds of steps such as manufacturing, molding, fabricating, assembling and finishing for the precision parts as described above.

As oils deposited to the material to be cleaned, there can be mentioned oils and fats, machine oils, cutting oils and greases.

The cleaning agent for the oil-deposited material according to the present invention is a mixture composed of 25 to 90 % by weight of at least one of compounds selected from the group consisting of pyrrolidones, γ-butyrolacton and N,N-dimethylacetamide, and 10 to 75% by weight of water.

If the water content is too small, there is a problem in view of the persistency of the degreasing and cleaning effect. That is, since the solubility of oils into the cleaning agent is increased upon using the cleaning agent repeatingly, it forms an emulsion to increase the amount of the redeposited oils after the cleaning step, as well as the cleaning agent has a flashing point and is required to be handled as a dangerous material, which brings about a problem in view of safety. On the contrary, if the water content is too large, the degreasing and cleaning agent effect is lowered.

If the water content is within the above-mentioned range, the degreased oils after the degreasing treatment tend to float and separate easily without dissolution of the degreased oils, so that the cleaning agent can be used repeatingly for a long period of time with no requirement for entirely recovering or periodically replacing the cleaning agent. Also, it can be handled as a non-dangerous material since the cleaning agent shows no flammability due to the water content, particularly, of not less than 15% by weight.

A preferred cleaning agent is a mixture of N-methyl-2-pyrrolidone and water. The content of N-methyl-2-pyrrolidone is, usually, 25 to 90 % by weight, preferably 50 to 90 % by weight, more preferably 70 to 85% by weight, while the content of water is usually 10 to 75% by weight, preferably 10 to 50% by weight, more preferably 15 to 30% by weight.

It has unexpectedly been found as an effect of using the mixture of N-methyl-2-pyrrolidone and water that formation of peroxides due to partial oxidation of N-methyl-2-pyrrolidone in atmospheric air can be suppressed remarkably by the addition of water. Since the cleaning agent is usually used repeatingly, suppression of the formation of peroxides is extremely advantageous in view of the stability for the performance of the cleaning agent and safety in use.

As other cleaning agents usable in the present invention, there can be mentioned a mixture containing at least one of pyrrolidone compounds other than N-methyl-2-pyrrolidone, γ-butyrolacton and N,N-dimethylacetamide, and water.

As the pyrrolidone compounds other than N-methyl-2-pyrrolidone, there can be mentioned, for example, 2-pyrrolidone, 3-pyrrolidone, N-alkyl-2-pyrrolidone (for example, N-ethyl-2-pyrrolidone, and N-propyl-2-pyrrolidone), 5-alkyl-2-pyrrolidone (for example, 5-methyl-3-pyrrolidone, 5-ethyl-2-pyrrolidone and 5-propyl-2-pyrrolidone), N-vinyl-2-pyrrolidone, N-alkyl-3-pyrrolidone (for example, N-methyl-3-pyrrolidone, N-ethyl-3-pyrrolidone and N-propyl-3-pyrrolidone). The pyrrolidone compounds may be used alone or as a mixture of two or more of them.

The cleaning agent, usually comprises 25 to 90 % by weight, preferably 25 to 65% by weight, more preferably 40 to 65% by weight of pyrrolidones other than N-methyl-2-pyrrolidone or γ-butyrolacton and 10 to 75% by weight, preferably 35 to 75% by weight, more preferably 35 to 60% by weight of water. Also, the cleaning agent, usually comprises 25 to 90 % by weight, preferably 25 to 75% by weight, more preferably 40 to 75% by weight of N,N-dimethyl acetamide and 10 to 75% by weight, preferably 25 to 75% by weight, more preferably 25 to 60% by weight of water.

In the cleaning agents as described above, since the oils are not only dissolved but also can be floated and separated after the degreasing treatment, the cleaning agents can be used repeatingly. In addition, since the cleaning agents do not show flammability, they can be preferably handled as non-dangerous material.

In the cleaning agent used in the present invention, the oil-eliminating effect can be improved and more excellent cleaning effect can be attained by blending a small amount of an alkali compound. In this case, the blending amount of the alkali compound, as the concentration in the cleaning agent, is not more than 1.0% by weight, preferably 0.1 to 1.0% by weight, more preferably 0.03 to 0.5% by weight. As the alkali compound to be blended, there can be mentioned hydroxides, carbonates and acetates of alkali metals or alkaline earth metals, as well as organic amines. Hydroxides of alkali metals such as sodium hydroxide or potassium hydroxide and hydroxides of alkaline earth metals such as calcium hydroxide are preferred.

Further, an antioxidant may be added for preventing effectively the formation of the peroxides upon repeating use of the cleaning agent. As the antioxidant, phenolic-type, phosphite-type or sulfur-type antioxidant can be used generally.

As the phenolic-type oxidants, there can be mentioned, for example, monophenolic compounds such as 2,6-di-tert-butyl-4-methylphenol, 2,5-di-tert-butylhydroquinone and 2,6-di-tert-butyl-α-dimethylamino-P-cresol; bisphenolic compounds such as 4,4'-bis(2,6-di-tert-butylphenyl), 2,2'-methylene-bis (4-methyl-6-tert-butylphenol), 4,4'-methylene-bis (2,6-di-tert-butylphenol) and 4,4'-butylidene-bis (3-methyl-6-tert-butylphenyl); thio bisphenolic compounds such as 4,4'-thiobis(3-methyl-6-tert-butylphenyl), 2,2'-thiobis (6-tert-butyl-o-cresol) and 2,2'-thiobis(4-methyl-6-tert-butylphenol); and trisphenolic compounds such as tetrakis (methylene-3-(3,5-di-tert-butyl-4-hydroxyphenyl)propionate)methane and tris (2-methyl-4-hydroxy-5-tert-butylphenol )butane.

As the phosphite-type antioxidant, there can be mentioned, for example, triphenylphosphite, trisnonylphenylphosphite, trioctylphosphite and tris (mono- and di-nonylphenyl)phosphite.

As the sulfur-type antioxidant, there can be mentioned, for example, dilaurylthiodipropionate and distearylthiodipropionate.

The antioxidants as described above may be used alone or as a mixture thereof. The amount of the antioxidant used, as a concentration in the cleaning agent, is not more than 1.0% by weight, preferably 0.01 to 1.0% by weight, more preferably 0.05 to 0.7% by weight. If the amount is excessive, the effect is not increased substantially, resulting in the increased cost, as well as it undesirably causes stains after cleaning.

The method of cleaning the oil-deposited material according to the present invention can be conducted easily by cleaning the deposited oils using the cleaning agent described above, then eliminating at least a portion of the deposited cleaning agent by a physical means from the material to be cleaned and then water-washing the same with water and/or steam.

More specifically, the following method is preferably adopted.

Namely, an oil-deposited material to be cleaned by the cleaning agent of the present invention is usually subjected to cleaning treatment by various cleaning methods such as soaking method, ultrasonic cleaning method, vibrating method or spraying method at a temperature usually from 20° to 150° C., preferably 40° to 80° C., thereby degreasing and cleaning oils deposited to the material to be cleaned.

In the degreasing and cleaning, when the soaking method is adopted, the cleaning effect can be further improved by passing air or nitrogen into the cleaning agent to cause bubbling. Bubbles can easily be formed by blowing a gas such as air or nitrogen during cleaning. The blowing amount of the gas is usually from 0.2 to 20 Nl/min per one liter of the cleaning solution, which may be properly controlled depending on the desired cleaning effect and the evaporation amount of water. The time required for the cleaning is usually from several minutes to several tens minutes.

When the physical action of bubbles, that is, the stirring effect of the cleaning agent (cleaning solution) and physical eliminating action to the oils by the bubbles are exerted, the cleaning effect is remarkably improved. Further, bubbles also have an effect of rapidly moving the oils eliminated from the material to be cleaned to the surface of the solution of the cleaning agent (the dissolving power of the cleaning solution used in the present invention to the oil is low, and the cleaning action exclusively depends on the separation of the deposited oils from the material to be cleaned. Accordingly, separated oils float as oil droplets in the cleaning solution).

The oils floated and separated at the surface of the cleaning solution can be removed properly by overflowing together with a portion of the cleaning agent or using an oil skimmer device or the like.

Further, in the soaking method, if the oils deposited to the material to be cleaned are highly viscous oils, for example, press oils, drawing oils and heat process oils having dynamic viscosity, for example, within a range usually from 50 to 2,000 centistokes, particularly, 100 to 1000 centistokes at a temperature of 40° C. application of ultrasonic cleaning method is particularly effective. There is no particular restriction on the condition of the ultrasonic cleaning and any of ultrasonic generators employed usually may be used while setting the ultrasonic vibration frequency to 10–100 KHz, preferably 15–50 KHz.

Then, a cleaning agent slightly deposited to the material to be cleaned after cleaning the oils is eliminated by a physical means. As the physical means for eliminating the cleaning agent from the material to be cleaned, it is preferred to blow a gas, for example, air or nitrogen to the material to be cleaned and blow out to remove the deposited cleaning agent. The blowing speed or the blowing time of the gas may be selected properly depending on the shape of the material to be cleaned, the residual deposition amount of the cleaning solution or the like. Further, instead of blowing the gas, a centrifugal force may be exerted on the material to be cleaned, thereby eliminating the cleaning agent. The thus separated cleaning agent is recovered and supplied to a cleaning vessel.

With the method as described above, the cleaning agent is recovered to reduce the loss of the cleaning agent caused by cleaning as low as possible, and the dissolution amount of the cleaning agent by the water-washing in the succeeding step is decreased as low as possible, thereby lightening the burden of the waste-water treatment. In this case, the blowing amount of the gas may be in such an amount that the cleaning agent deposited to the material to be cleaned can be blown out and removed in a short period of time and, although it can not be determined generally depending on the shape and the size of the material to be cleaned, it is preferred to increase the linear velocity of the gas at a gas nozzle used as high as possible.

Then, for the material subjected to eliminating treatment for the cleaning agent, the cleaning agent still remaining on the surface is removed by water-washing. Since the boiling point of the organic compound such as pyrrolidones used in the present invention is high, such organic compounds remaining on the surface of the material to be cleaned can not be completely evaporated and removed by mere blowing of the gas. For the water-washing method, various kinds of cleaning methods can be used, such as soaking method, ultrasonic cleaning method, vibrating method and spraying method.

For the water-washing, a method of soaking the material to be cleaned into a water-washing vessel containing water, or a method of injecting water recycled by a pump, to the material to be cleaned can be used. Water is used preferably at an ordinary temperature or an elevated temperature. Particularly, water at a temperature of 40° to 80° C. is more preferred. A water-washing vessel is usually used but a plurality of water-washing vessels may be arranged in series, if required. In this case, washing water may be supplied to each of the water-washing vessels, but it is preferably moved in a counterflow manner to the material to be cleaned in each of the water-washing vessels in accordance with the customary method.

It is preferred to blow air or other gas into the water-washing vessel to raise bubbles in the vessel in the same manner as the cleaning vessel. Water is stirred, thereby promoting the removal of the cleaning agent deposited to the material to be cleaned and also promoting the evaporation of water in the vessel, so that water balance can be established easily over the entirely cleaning system.

Further, depending on the case, a method of blowing steams to the degreased and cleaned material to be cleaned, thereby blowing out to remove the cleaning agent deposited can also be adopted as the method of water-washing. This method can decrease the amount of water used and lighten the burden of the waste-water treatment as compared with the water-washing method of soaking the material to be cleaned in the washing water. In this case, the blowing amount and the blowing speed of the steams are, preferably, such that the cleaning agent deposited to the material to be cleaned is blown off and removed in a short period of time. The temperature of the steams is usually 90° to 130° C. A preferred blowing amount of the steams is usually about 60 to 6,000 kg/hr per 1 $m^2$ of the surface area of the material to be cleaned.

In the water-washing step as described above, it is necessary to always supplement fresh water and extract a portion of water containing the organic compound ingredient from the water-washing vessel as the washing water waste, in order to prevent accumulation of the cleaning agent ingredient such as pyrrolidones in water. In the present invention, the extracted washing water waste may be supplied at least partially, preferably, entirely to the cleaning vessel as supplemental water. Since water is partially lost for example, by evaporation from the cleaning vessel, water has to be supplemented externally in order to maintain the composition of the cleaning agent. As supplemental water, washing-water waste generated in the water-washing step can also be used as well. This can prevent the loss of the cleaning agent ingredient and lighten or save the burden of the waste-water treatment. The administration for the concentration of the cleaning agent can easily be carried out based on the measured values for the physical properties of the cleaning agent such as refractive index and density by a usual instrumental analysis.

For the materials to be cleaned after water-washing, water deposited on the surface is usually dried and removed. There is no particular restriction for the drying and removing method of water so long as it is a well known drying method, and there can be mentioned, for example, gas blowing method, spontaneous drying method, vacuum drying method and infrared irradiation method. Among the methods, a gas blowing method is preferred as a method of drying and removing water in a short period of time. According to this method, water is dried by blowing off and removing the same by blowing a gas such as air or a nitrogen at an ordinary or elevated temperature. In this case, the blowing amount of the gas may be enough so long as it is such an amount as capable of blowing out and removing the water deposited on the materials to be cleaned in a short period of time. Although the amount can not be defined generally, depending on the shape and the size of the materials to be cleaned, it is preferred to increase the linear velocity of the gas at the gas nozzle as high as possible.

The method of cleaning the oil-deposited materials according to the present invention can be practiced easily by an apparatus for cleaning the oil-deposited materials according to the present invention. Description will now be in more details to an apparatus for cleaning oil-deposited materials according to the present invention with reference to the drawings.

Figure 2:
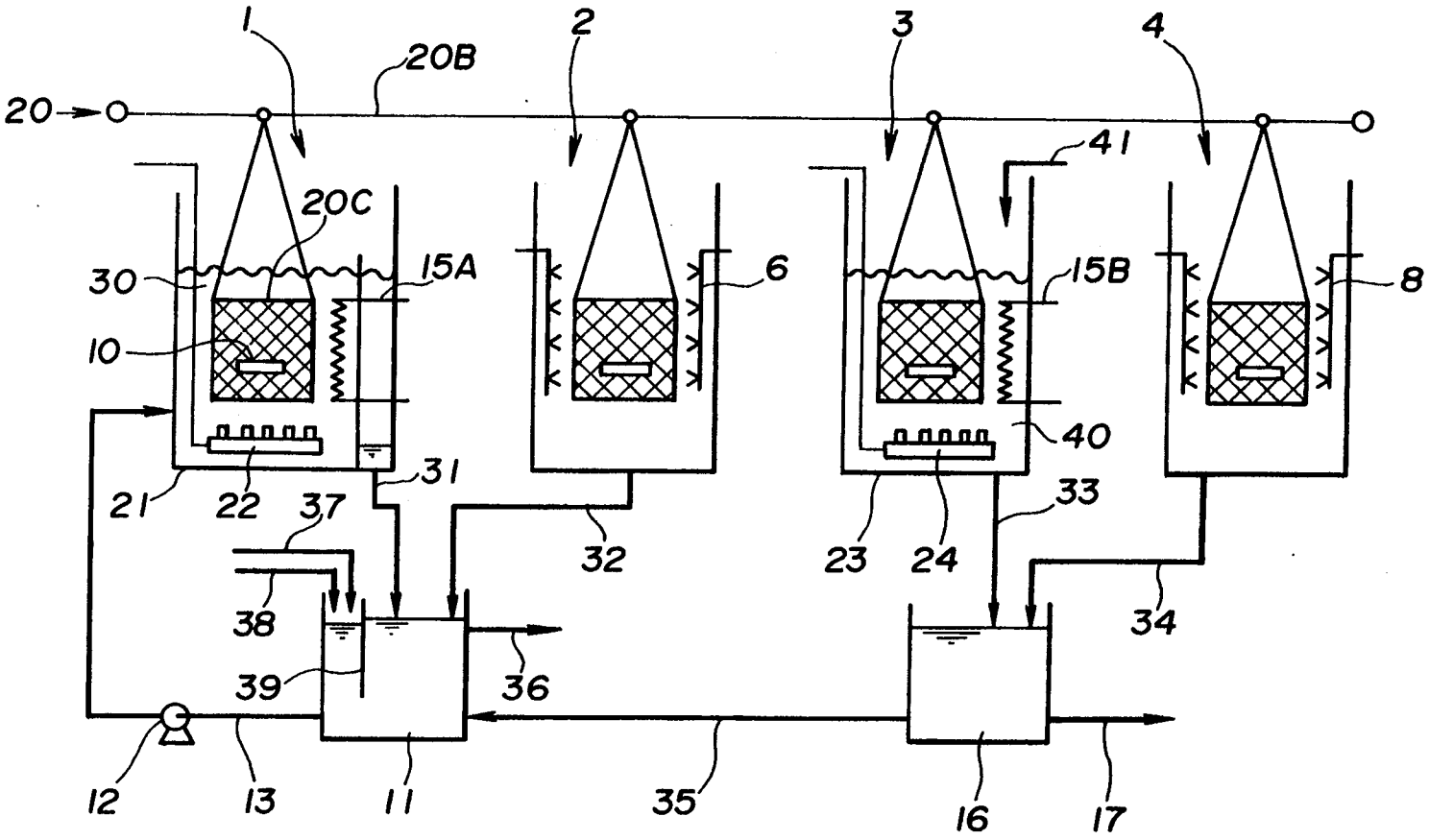
FIG. 2 is an explanatory view illustrating another preferred embodiment of an apparatus for cleaning an oil-deposited material according to the present invention.

FIGS. 1 and 2 are explanatory views illustrating a preferred embodiment of an apparatus for cleaning an oil-deposited materials according to the present invention.

The cleaning apparatus shown in FIGS. 1 and 2 mainly comprises an oil-cleaning section 1 for cleaning a material 10 to be cleaned having oils deposited on the surface thereof with a cleaning agent 30 containing pyrrolidones, γ-butyrolacton and/or N,N-dimethylacetamide; a gas blowing section (deposit-eliminating section) 2 for blowing off and removing a cleaning agent deposited on the material to be cleaned with a gas after treating the oil-cleaning section 1; a water-washing section 3 for removing the cleaning agent remaining on the surface of the material to be cleaned by a water-washing treatment after treating the gas blowing section 2; a gas blowing and drying section 4 for blowing out and removing water deposited on the materials to be cleaned after treating the water-washing section 3 ;and a transporting device 20 for transporting the material 10 to be cleaned by way of the oil-cleaning section 1, the gas blowing section 2, the water-washing section 3 and the gas blowing and drying section 4 (belt conveyor 20A, and lift 20B).

In the cleaning apparatus shown in FIG. 1, the cleaning agent 30 in a cleaning agent recovery vessel 11 disposed below the oil-cleaning section 1 and the gas blowing section (deposit-eliminating section) 2 is supplied to a spray nozzle 5 by way of a pipeline 13 having a pump 12. A filter 14 is disposed above the cleaning agent recovery vessel 11 for preventing the intrusion of dusts and the like together with the cleaning agent used for the cleaning of the material 10 to be cleaned into the cleaning agent recovery vessel 11. Further, a heater 15 is disposed to the cleaning agent recovery vessel 11 for heating the cleaning agent to an optimal temperature. Gas nozzles 6, 8 are disposed such that a gas, for example, air or nitrogen is blown to the material 10 to be cleaned. The washing-water sprayed from the spray nozzle 7 is recovered by a washing-water waste recovery vessel 16 disposed below the water-washing section 3 and the gas blowing and drying section 4, and a part of the recovered water is sent from a pipeline 17 to a waste-water treating device (not illustrated).

In more details, the oil-cleaning section 1 comprises a cleaning agent recovery vessel 11 disposed below a transportation device 20, and a spray nozzle 5 equipped therein and disposed above the transportation device 20 for a material to be cleaned. The cleaning agent recovery vessel 11 provides a heater 15 disposed in the lower portion for heating the recovered cleaning solution. A pipeline 13 is connected to the cleaning agent recovery vessel 11 by way of a filter and a pump 12, and a filter 14 disposed to the upper opening of the recovery vessel for preventing the intrusion of dusts. Another end of the pipeline 13 is connected to the spray nozzle 5 for recycling the cleaning agent. A gas blowing section 2 is disposed in combined with the oil-cleaning section 1, and a gas nozzle 6 is equipped in the gas blowing section 2 and disposed above the transportation device 20. The opening of the cleaning agent recovery vessel 11 (not provided with the filter) is extended to the lower part of the gas blowing section and disposed below the transportation device 20 for recovering a cleaning solution blown out by a gas jetted out of the gas nozzle 6. A spray nozzle 7 for washing water is equipped in a water-washing section 7 which is disposed in combined with the gas blowing section 2, for supplying washing water and a washing-water waste recovery vessel 16 is disposed therebelow. A gas nozzle 8 is disposed above the transportation device 20 in a gas blowing and drying section 4 which is disposed in combined with the water-washing section 3, and washing-water waste recovery vessel 16 is extended to therebelow. The washing-water waste recovery vessel 16 is connected to the recovery vessel 11 and a waste-water treating device (not illustrated) by way of pipelines 17 and 35, respectively. A part of the washing-water waste accumulated in the washing-water waste recovery vessel 16 is sent to the cleaning agent recovery vessel 11 by way of the pipeline 35, and a remaining washing-water waste accumulated in the washing-water waste recovery vessel 16 is sent by way of a pipeline 17 to the waste-water treating device.

In the cleaning apparatus of this embodiment shown in the FIG. 1, the material 10 to be cleaned is supplied onto the conveyor 20A and then transported successively rightward in the drawing by the belt conveyor 20A. That is, the material 10 to be cleaned at first enters into the oil-cleaning section 1, in which the heated cleaning agent 30 is sprayed through the spray nozzle 5 to the material 10 to be cleaned, thereby cleaning and removing the oils deposited to the material 10. Then, the cleaning agent deposited to the surface of the material 10 to be cleaned is blown out by the gas jetted out of the gas nozzle 6 during passage through the gas blowing section 2, by which most of the cleaning agent are removed. An excess cleaning agent in the oil-cleaning section 1 and the cleaning agent removed in the gas blowing section 2 are recovered in the cleaning agent recovery vessel 11 and recycled for reuse. Further, since the degreased oils float on the surface of the cleaning solution in the cleaning agent recovery vessel 11, the oils separated and floating on the surface of the cleaning liquid may be preferably overflowed together with a portion of the cleaning agent, or it may be separated and removed, for example, by utilizing an oil skimmer device (not illustrated).

Then, the treated material 10 is transported to the water-washing section 3 in which water (purified water, particularly, in a case of cleaning precision parts) is sprayed from a water spray nozzle 7 to the material 10 to be cleaned, thereby cleaning and removing the remaining cleaning agent. Subsequently, during passage of the material 10 to be cleaned through the gas blowing and drying section 4, water deposited to the surface thereof is blown out and removed by the gas jetted out from the gas nozzle 8. Thus, the material 10 to be cleaned passing through and taken out of the gas blowing and drying section 4 is entirely and completely dried. Washing-water waste in the water-washing section 3 and water removed in the gas blowing and drying section 4 are recovered in a washing-water waste recovering vessel 16 and then a part of the recovered washing-water waste and water are sent to a waste-water treating device.

In the cleaning apparatus shown in FIG. 2, a material 10 to be cleaned which is contained and suspended in a wire cage 20C of a lift 20B is soaked and washed in a cleaning vessel 21. The oil-cleaning vessel 21 provides a heater 15A for properly heating the cleaning agent 30, at the inside thereof and a gas nozzle 22 for supplying a gas such as air or nitrogen to the cleaning agent 30 for bubbling. Further, the cleaning agent is supplied from the gas blowing section (deposit-eliminating section) 2 which is disposed below the cleaning agent recovery vessel 11, to the cleaning vessel 21 by way of a pipeline 13 having a pump 12. A heater 15 may be disposed, if necessary, to the cleaning agent recovery vessel 11 for properly heating the recovered cleaning agent. Gas nozzles 6, 8 are constructed such that a gas such as air or nitrogen is blown to the material 10 to be cleaned. Further, the excess cleaning agent from the oil-cleaning section 1 and a portion of the cleaning agent removed in the gas blowing section 2 are recovered in the cleaning agent recovery vessel 11 and recycled for reuse.

In the water-washing section 3, the material 10 to be cleaned is soaked and washed in a washing-water reservoir 23, and a heater 15 is disposed for properly heating the washing-water 40 in the reservoir. Also in this washing-water reservoir 23, a gas nozzle 24 is disposed for supplying a gas such as air or oxygen for bubbling to the washing-water at the inside thereof. A washing-water waste recovery vessel 16 is disposed below the water-washing section 3 and the gas blowing and drying section 4 for recovering water blown off by the blowing of the gas and excess water from the cleaning water reservoir 23 by way of the pipelines 33 and 34, respectively.

In more details, the oil-cleaning section 1 comprises a oil-cleaning vessel 21 disposed below a transportation device 20B, and a gas nozzle 22 disposed at the bottom thereof and a heater 15A disposed on the side thereof for heating the cleaning agent in the oil-cleaning vessel 21. Air or nitrogen gas is supplied by way of a pipeline to the gas nozzle 22 and the oil-cleaning vessel 21 is equipped with an overflow solution receiver for receiving the cleaning agent that overflows upon soaking the material. The transportation device 20B is disposed above the oil-cleaning vessel 21 for suspending material to be cleaned, a cleaning agent recovery vessel 11 disposed below the oil-cleaning vessel 21 and the cleaning agent recovery vessel 11 is equipped with a partitioning plate 39. The cleaning agent recovery vessel 11 is in communication through a pipeline 13 with the oil-cleaning vessel 21 by way of a pump 12. The cleaning agent from the overflow solution receiver is sent by way of a pipeline 31 to the cleaning agent recovery vessel 11, and introduction pipelines 37 and 38 of supplementing cleaning agent and water are disposed to a portion of the cleaning agent recovery vessel 11 opposite to the portion which is partitioned by the partition plate 39. A gas blowing section 2 is disposed in combined with the oil-cleaning section 1, and the gas blowing section 2 has a gas nozzle 6 on the side thereof, to which the cleaning liquid accumulated by blowing in the lower portion thereof is sent from the vessel by way of a pipeline 32 to the cleaning agent recovery vessel 11. The water-washing section 3 which is disposed in combined with the gas blowing section 2 comprises a washing-water reservoir 23 in which the material to be cleaned is soaked and washed, a gas nozzle 24 disposed at the bottom thereof for bubbling and a heater 15B is disposed on the side thereof. The washing-water wastes are drained from the washing-water reservoir 23 by way of a pipeline 33 and sent to the washing-water waste recovery vessel 16. A washing-water supply pipe 41 is disposed above the washing-water reservoir 23. A gas blowing and drying section 4 which is disposed in combined with the water-washing section 3 comprises a vessel having a gas nozzle 8 on the side thereof, and the washing-water accumulated in the lower portion thereof by blowing is sent from the vessel by way of a pipeline 34 to the washing-waste water recovery vessel 16.

According to the cleaning apparatus shown in FIG. 2, the material 10 to be cleaned is contained in the wire cage 20C of the lift 20B and then transported successively rightward in the drawing. That is, the material 10 to be cleaned at first enters the oil-cleaning section 1, the wire cage 20C is lowered in the cleaning agent reservoir 21, soaked in the heated cleaning agent 30 and cleaned under bubbling. The material 10 in which the deposited oils are removed by the soaking treatment is once taken out of the cleaning agent reservoir 21 by the elevation of the wire cage 20C and, subsequently, entered in the gas blowing section 2, whereby almost of cleaning agent deposited to the surface thereof is blown out and removed by the gas jetted out of the gas nozzle 6.

The excess cleaning agent in the oil-cleaning section 1 and the cleaning agent removed by the gas blowing section 2 are recovered, respectively, by way of pipelines 31, 32 in the cleaning agent recovery vessel 11 and recycled for reuse.

Then, the material 10 to be cleaned is transported to the water-washing section 3, in which the wire cage 20C is lowered and soaked in heated washing water 40, and water-washed under bubbling. The material 10 to be washed, from which the residual cleaning agent has been washed and removed by the water-washing, is taken out by the elevation of the wire cage 20C and, subsequently, water deposited to the surface is blown out and removed by the gas jetted out from the gas nozzle 8 during passage through the gas blowing and drying section 4. The material 10 to be cleaned taken out of the gas blowing and drying section 4 is entirely dried completely. Further, excess waste water from the water-washing section 3 and waste water removed in the gas blowing and drying section 4 are recovered, respectively, through pipelines 33 and 34, in the waste water recovery vessel 16 and a portion thereof is taken out of the system through the pipeline 17.

Referring more specifically to the cleaning agent recovery vessel 11, when the cleaning agent used for cleaning is recovered in the cleaning agent recovery vessel 11, since the oils degreased from the material 10 to be cleaned float near the surface of the recovered solution in view of its specific gravity, the oils can be removed through a pipeline 36 out of the system. On the other hand, the cleaning agent after the separation of the oils is supplied by way of the pipe 13 to the cleaning vessel 21. A cleaning agent and water (if required) for supplement are also introduced through pipes 37 and 38 to the cleaning agent recovery vessel 11. A partition 39 may preferably be disposed in the cleaning agent recovery vessel 11 as shown in FIG. 2, so that the supplemental cleaning agent, water and recovered oils are not mixed. Further, a portion of the washing-water waste in the washing-water waste recovery vessel 16 is introduced, as required, through the pipeline 35 to the cleaning agent recovery vessel 11.

The cleaning apparatus as shown in FIGS. 1 and 2 is one embodiment of the cleaning apparatus according to the present invention, but the present invention is not restricted to the illustrated embodiment so long as it lies within in the scope of the invention. For instance, the cleaning method for the degreasing-cleaning and water-washing are not restricted to spray-cleaning or soaking-cleaning, but other cleaning methods as described above may also be used. Further, the transportation device for the material 10 to be cleaned is not restricted to the belt conveyor and the lift but other driving rollers, caterpillars, etc. may also be adopted. The transportation device preferably has a constitution capable of permeating cleaning agent or water and, in a case of the belt conveyor, it is advantageous to use a belt conveyor made of mesh or perforated material and a wire gage or wire tray is advantageously used in the case of the lift.

By the cleaning method for the oil-deposited material according to the present invention, material to be cleaned having deposited oils can be effectively cleaned to obtain satisfactory cleaning processing products, as well as the cleaning agent can be recovered from the material to be cleaned, thereby reducing the amount of the cleaning agent used. Further, it is also possible to reduce the amount of water required for water-washing, reduce the concentration of the cleaning agent in the waste water and lighten or save the burden in the waste-water treatment.

Further, according to the cleaning apparatus of the present invention, the cleaning method as described above can be carried out automatically.

Furthermore, according to the cleaning agent used suitably to the cleaning method and the cleaning apparatus described above, a cleaning agent having excellent degreasing and cleaning effect for oils, a satisfactory stability and a safety and sanitation for working circumstance, and being free from the worry of environmental pollution can be provided.

EXAMPLE

The present invention will now be described more in details with reference to specific examples and reference examples.

Examples 1–6 and Comparative Examples 1–2

The following experiments were carried out in order to confirm the degreasing and cleaning effects of cleaning agents.

After soaking test pieces (each 2.98 cm×4.98 cm×0.3 cm thickness) made of the materials shown in Table 1 in a cutting oil, they were soaked in and then taken out of cleaning agents having compositions as shown in Table 1 and each comprising a mixture of N-methyl-2-pyrrolidone (NMP) and water, at a temperature and for a time shown in Table 1. The remaining states of the oils at the surface of the test pieces were observed with naked eyes and evaluated by the following evaluation criterion. Further, the separating and floating property of the oils upon soaking treatment was observed with naked eyes to judge the adequacy. The results are shown in Table 1. Criterion for Evaluation ○: completely removed Δ: slightly remaining ×: considerably remaining Further, a fire test was carried out for each of the cleaning agents according to JIS K2265 "Test Method for Flashing Point of Crude Oils and Petroleum Products" and the results are also shown together in Table 1.

Further, after the cleaning, the floating oils were removed and the same procedures were repeated, by which the remaining states of the oils at the surface of the test pieces upon repeating use for hundred of times were also observed and the results are shown together in Table 1.

It is apparent from Table 1 that oil-deposited materials can be cleaned efficiently and the oils can be removed substantially completely in Examples 1–3 using the cleaning agent containing NMP, particularly, a mixture of NMP and water containing 50 to 90 % by weight of NMP and 10 to 50% by weight of water. By blowing air to the cleaned test pieces and then water-washing the treated test pieces, NMP deposited on the test pieces can be removed completely.

TABLE 1

| Example & Comparative Example No. | Material | Composition of cleaning agent (wt %) NMP | Water | Soaking treatment Temp. (°C.) | Time (min) | Result of observation after soaking treatment First | At 100th times | Oil separating and floating property upon soaking treatment | Fire test |
|---|---|---|---|---|---|---|---|---|---|
| Ex. 1 | Al | 80 | 20 | 25 | 20 | ○ | ○ | good | not flashed |
| Ex. 2 | SS-41 | 80 | 20 | 25 | 20 | ○ | ○ | good | not flashed |
| Ex. 3 | SUS-304 | 80 | 20 | 25 | 20 | ○ | ○ | good | not flashed |
| Ex. 4 | Al | 30 | 70 | 60 | 50 | Δ | X | good | not flashed |
| Comp. Ex. 1 | Al | 20 | 80 | 80 | 90 | X | X | good | not flashed |
| Comp. Ex. 2 | Al | 100 | 0 | 25 | 20 | ○ | X | poor (suspended) | flashing point at 95° C. |

Reference Examples 1–6

To 100 parts by weight of NMP, water was admixed by each of amounts shown in Table 2 and then left in an atmospheric air at each of temperatures shown in Table 2. The amount of peroxides in the mixed solutions after elapse of each of the days shown in Table 2 was measured by a potassium iodide method. The results are shown in Table 2.

From Table 2, it is seen that formation of peroxides was remarkably suppressed with the mixture of NMP and water in Reference Examples 1–5 as compared with Reference Example 6 not containing water.

TABLE 2

| Reference Example | Water addition amount (pbw) | Temp. (°C.) | Amount of peroxide (meq/kg) After 1 day | After 5 days | After 9 days | After 24 days | After 29 days |
|---|---|---|---|---|---|---|---|
| 1 | 33 | 25 | 0.7 | 1.0 | 1.3 | 1.9 | 2.1 |
| 2 | 100 | 25 | 0.5 | 0.5 | 0.5 | 0.6 | 0.7 |
| 3 | 100 | 60 | — | — | less than 0.5 | — | less than 0.5 |
| 4 | 100 | 70 | — | — | less than 0.5 | — | less than 0.5 |
| 5 | 100 | 100 | — | — | less than 0.5 | — | 0.6 |
| 6 | 0 | 25 | 1.5 | 13.1 | 25.9 | 56.2 | 60.5 |

Comparative Example 3

After measuring the weight of a test piece made of SS-41 (2.98 cm×4.98 cm×0.3 cm thickness, total surface: 34.5 cm$^2$), the test piece was soaked in a cleaning agent vessel containing a mixture of NMP and water [NMP/water=85/15 (weight ratio)] for 20 min and then left till the weight thereof was settled constant (determined as after 30 min). Then, the weight thereof was measured and the deposition amount was calculated.

Subsequently, the specimen was washed with 100 cc of water and the amount of NMP transferred to the aqueous phase was calculated by analyzing the NMP concentration in the aqueous phase, to determine the recovery ratio for NMP. Each of the measured value and calculated value is shown in Table 3.

It was confirmed that the transferring amount corresponded substantially to the depositing amount and that NMP could be removed by water washing. Also, it was recognized by IR analysis that there was no surface deposition matters.

Example 5

The cleaning method was conducted under the quite same conditions as those in Comparative Example 3 except for applying air blowing to the test piece taken out from the cleaning agent vessel. As the air blowing condition, 15 Nl/min of air was blown from two vertical directions to the test piece for 20 min, each at 5 cm distance from a nozzle of 6/4 (mm)$\phi$.

The results are shown in Table 3.

Example 6

The cleaning method was conducted in the same procedures as those in Example 5 except for changing the air blowing condition as 10 Nl/min for 20 min. The results are shown in Table 3.

TABLE 3

| Example & Comparative Example | Comp. Ex. 3 | Example 5 | Example 6 |
|---|---|---|---|
| Test piece weight (measured value) | 34.73 | 34.74 | 34.73 |
| Weight after soaking in cleaning agent (measured value) (g) | 34.93 | 34.95 | 34.93 |

TABLE 3-continued

| Example & Comparative Example | Comp. Ex. 3 | Example 5 | Example 6 |
|---|---|---|---|
| Cleaning agent deposition amount (calculated value) (g) | 0.20 | 0.21 | 0.20 |
| Air blowing condition | None | 15 Nl/min for 20 min | 10 Nl/min for 20 min |
| NMP concentration in aqueous phase after 100 cc water washing (ppm) | 1995 | 7 | 42 |
| NMP recovery ratio to washing water (wt %) | 99.75 | 0.33 | 2.10 |

As seen from Table 3, NMP can be removed substantially completely by water-washing, and the deposited cleaning agent can be removed and recovered substantially completely by applying gas blowing before water-washing, so that the amount of the cleaning agent used can be reduced and the cost for treating waste water caused by water-washing cost can be reduced.

Reference Examples 7–12 & Comparative Example 4–6

The following experiments were carried out in order to confirm the degreasing and cleaning effects of cleaning agents.

Each of test pieces (29.8 mm×49.8 mm×3.0 mm thickness) of the materials shown in Table 4 was soaked in a cutting oil, then soaked in 100 cc of a degreasing cleaning agent comprising each of compositions as shown in Table 4 at each of temperatures and for each of times shown in Table 4. Then the state of oils remaining on the surface of the recovered test piece was evaluated in the same way as in Examples 1–4 and Comparative Examples 5–6, and the results are shown in Table 4. By blowing air to the cleaned test pieces and then water-washing the treated test pieces, NMP deposited on the test pieces can be removed completely.

Comparative Example 7

After measuring the weight of a test piece made of SS-41 (2.98 cm×4.98 cm×0.3 cm thickness, total surface area: 34.5 $cm^2$), it was soaked in a cleaning agent vessel containing GBL/$H_2O$=60/40 weight ratio (GBL: γ-butyrolactone) and then taken out and left till the weight thereof was settled constant (determined as after 30 min). Then the weight thereof was measured and the deposition amount was calculated.

Then, specimen was washed with 100 cc of water and GBL concentration in the aqueous phase was analyzed to calculate the amount of GBL transferred to the aqueous phase, thereby determining the recovery date for GBL. Each of the measured value and calculated value is shown in Table 5.

It was confirmed that the transferred amount substantially corresponds to the deposition amount and that GBL could be removed by water washing. It was also confirmed by IR analysis that there was no surface deposition matters.

Example 13

This example was conducted under the quite identical conditions as those in Comparative Example 7 except for applying air blowing to the test piece taken out from the cleaning agent vessel. As the air blowing condition, 15 Nl min of air was blown from two vertical directions to the test piece for 20 min, each at 5 cm distance from a nozzle of 6/4 (mm)ϕ.

The results are shown in Table 5.

Example 14

The cleaning method was conducted in the same procedures as those in Example 13 excepting for changing the air blowing condition as 10 Nl/min for 20 min. The results are shown in Table 5.

TABLE 4

| Example & Comparative Examples | Material of test piece | Cleaning agent blend (wt %) | | Soaking condition Temp. (°C.) | Soaking condition Time (hr) | Result for the observation of appearance of material to be cleaned after soaking First | Result for the observation of appearance of material to be cleaned after soaking 100th | Oil floating and separating property in soaking | Hazerdness Flammability |
|---|---|---|---|---|---|---|---|---|---|
| Ex. 7 | A1 | GBL 60 | water 40 | 60 | 1 | ○ | ○ | good | not flashed |
| Ex. 8 | SS41 | GBL 60 | water 40 | 60 | 1 | ○ | ○ | good | not flashed |
| Ex. 9 | SUS304 | GBL 60 | water 40 | 60 | 1 | ○ | ○ | good | not flashed |
| Ex. 10 | SUS304 | GBL 40 | water 60 | 60 | 2 | ○ | ○ | good | not flashed |
| Ex. 11 | SUS304 | 2PD 60 | water 40 | 60 | 1 | ○ | ○ | good | not flashed |
| Ex. 12 | SUS304 | DMA 60 | water 40 | 60 | 1 | ○ | ○ | good | not flashed |
| Comp. Ex. 4 | SUS304 | GBL 100 | water 0 | 60 | 1 | Δ | X at 10th | poor (suspended) | flashing point: 101° C. |
| Comp. Ex. 5 | SUS304 | 2PD 100 | water 0 | 60 | 1 | Δ | X at 10th | poor (suspended) | flasing point: 145° C. |
| Comp. Ex. 6 | SUS304 | DMA 100 | water 0 | 60 | 1 | Δ | X at 10th | poor (suspended) | flashing point: 70° C. |

(Note)
GBL: γ-butyrolactone, 2PD: 2-pyrrolidone, DMA: N,N-dimethylaetamide
First: In a case of applying soaking treatment by a not yet used cleaning agent
100th: In a case of applying soaking treatment by a cleaning agent already used by 99 times for soaking.

It can be seen from Table 5 that NMP can be removed substantially completely by water washing, and the deposited cleaning agent can be removed and recovered substantially completely by applying gas blow before water washing, so that the amount of the cleaning agent used can be reduced and the cost for processing waste water caused by water washing can be reduced.

Example 15

Oil-deposited material were cleaned by using the apparatus shown in FIG. 2. 20 metal pieces (material: SS41, sized: 2.98 cm×4.98 cm×0.3 cm) deposited with cutting oils were placed in a wire cage and then soaked in a cleaning agent vessel (35 cm in diameter×40 cm in depth) containing a cleaning agent [a mixture of NMP and water (NMP/water=80/20 (weight ratio)]. They were cleaned at 60° C. for 3 min while blowing air at 200 Nl/min. The wire cage was taken out of the cleaning vessel and transferred into a deposit separating vessel, to which air at an ordinary temperature was blown at 200 Nl/min for 5 min to separate the deposited cleaning agent. Subsequently, the wire cage was placed in a water washing vessel (35 cm in diameter×40 cm in depth) containing an aqueous 2 wt % solution of NMP and water, washed at 60° C. for 2 min while blowing air at 200 Nl/min. The wire cage was taken out of the water washing vessel and transferred to a drying vessel, and the metal pieces were dried by blowing air at a temperature of 120° C. for 5 min at 200 Nl/min. The above-mentioned processing was conducted continuously each at a 5 min interval. Water was supplemented to the water washing vessel, and a portion of water in the washing vessel was extracted and supplied to the cleaning vessel such that the concentration of NMP was maintained at 2% by weight.

As a result, the entire amount of the washing waste water in the water washing vessel could be recycled to the cleaning vessel. Further, when the cleaning treatment was conducted continuously for 100 times, oils deposited to the metal specimens were completely removed under observation with naked eyes.

TABLE 5

| Examples & Comparative Example | Comp. Ex. 7 | Example 13 | Example 14 |
|---|---|---|---|
| Test piece weight (measured value) (g) | 35.12 | 35.13 | 35.14 |
| Weight after soaking in cleaning agent (measured value) (g) | 35.32 | 35.34 | 35.34 |
| Cleaning agent deposition amount (calculated value) (g) | 0.20 | 0.21 | 0.20 |
| Air blowing condition | None | 15 Nl/min for 20 min | 10 Nl/min for 20 min |
| GBL concentration in aqueous phase after 100 cc water washing (ppm) | 1805 | 10 | 50 |
| NMP recovery rate to washing water (wt %) | 90.25 | 0.48 | 2.50 |

What is claimed is:

1. A method of cleaning an oil-deposited material, which comprises the steps of:

cleaning a material having oils deposited on the surface thereof with a cleaning agent that floats and separates oil, said agent consisting of 25 to 90% by weight of at least one of compounds selected from the group consisting of pyrrolidones, γ-butyrolactone and N,N-dimethylacetamide, and 10 to 75% by weight of water;

eliminating at least a portion of the deposited cleaning agent from said material by a physical means;

washing with water, steam, or water and steam; and removing oil which has been floated and separated from the cleaning agent.

2. A cleaning method according to claim 1, wherein as the cleaning agent, a mixture composed of 50 to 90 % by weight of N-methyl-2-pyrrolidone and 10 to 50% by weight of water is used.

3. A cleaning method according to claim 2, wherein said mixture is composed of 70 to 85% by weight of N-methyl-2-pyrrolidone and 15 to 30% by weight of water.

4. A cleaning method according to claim 1, wherein as the cleaning agent, a mixture composed of 25 to 65% by weight of 2-pyrrolidone and 35 to 75% by weight of water is used.

5. A cleaning method according to claim 1, wherein as the cleaning agent, a mixture composed of 25 to 65% by weight of γ-butyrolactone and 35 to 75% by weight of water is used.

6. A cleaning method according to claim 1, wherein as the cleaning agent, a mixture composed of 25 to 75% by weight of N,N-dimethylacetamide and 25 to 75% by weight of water.

7. A cleaning method according to claim 1, wherein the cleaning step is accomplished by spraying said cleaning agent at a temperature of 40° to 80° C. on the surface of the oil-deposited material.

8. A cleaning method according to claim 1, wherein the cleaning step is accomplished by soaking the oil-deposited material in said cleaning agent at a temperature of 40° to 80° C.

9. A cleaning method according to claim 1, wherein the physical means for eliminating at least a portion of the deposited cleaning agent from the material to be cleaned is a method of blowing a gas to said material to be cleaned.

10. A cleaning method according to claim 9, wherein the gas is air or nitrogen.

11. A cleaning method according to claim 1, wherein the washing step is accomplished by spraying at a temperature of 40° to 80° C. on the oil-deposited material.

12. A cleaning method according to claim 1, wherein the washing step is accomplished by soaking the oil-deposited material in water at a temperature of 40° to 80° C.

13. A cleaning method according to claim 1, wherein the washing step is accomplished by blowing steam at a temperature of 90° to 130° C. on the oil deposited material.

14. The method as claimed in claim 1 wherein said cleaning agent further consists essentially of 0.1–1.0% by weight of an alkali compound selected from the group consisting of hydroxides, carbonates, and acetates of alkali metals and alkaline earth metals and, optionally, a phenolic, phosphite or sulfur antioxidant in an amount of from 0.01–1.0% by weight.

15. A method of cleaning an oil-deposited material comprising the steps of applying a cleaning agent which floats and separates oil consisting essentially of 25 to 90% by weight of at least one of compounds selected from the group consisting of pyrrolidones, γ-butyrolactone and N,N-dimethylacetamide, and 10–75% by weight of water, to an oil-deposited surface of the material to be cleaned;

eliminating at least a portion of the deposited cleaning agent from said material to be cleaned by physical means;

water-washing with , steam or water and steam;

removing oil which has been separated and floated from the oil-deposited material from said cleaning agent to provide recycled cleaning agent, and repeating the above steps at least once with said recycled cleaning agent.

16. The method as claimed in claim 15 wherein said cleaning agent further consists essentially of 0.1–1.0% by weight of an alkali compound selected from the group consisting of hydroxides, carbonates, and acetates of alkali metals and alkaline earth metals and, optionally, a phenolic, phosphite or sulfur antioxidant in an amount of from 0.01–1.0% by weight.

* * * * *

UNITED STATES PATENT AND TRADEMARK OFFICE

CERTIFICATE OF CORRECTION

PATENT NO. : 5,399,203

DATED : MARCH 21, 1995

INVENTOR(S) : MAKOTO ISHIKAWA ET AL

It is certified that error appears in the above-identified patent and that said Letters Patent is hereby corrected as shown below:

Column 18, claim 11, line 44, after "spraying", insert --water--.

Signed and Sealed this

Eighth Day of August, 1995

Bruce Lehman

*Attest:*

BRUCE LEHMAN

*Attesting Officer*

*Commissioner of Patents and Trademarks*